United States Patent [19]

Crepinsek

[11] Patent Number: 4,577,896

[45] Date of Patent: Mar. 25, 1986

[54] STRIKE PLATE AND SECURITY CHAIN LATCH

[76] Inventor: Alois Crepinsek, 97 N. Arizona Pl., Chandler, Ariz. 85224

[21] Appl. No.: 411,687

[22] Filed: Aug. 26, 1982

[51] Int. Cl.[4] ..... E05C 17/36

[52] U.S. Cl. ..... 292/264; 292/340; 292/341.17

[58] Field of Search ..... 292/264, 340, 346, 341.15, 292/341.17; 70/93

[56] References Cited

U.S. PATENT DOCUMENTS

| | | | |
|---|---|---|---|
| 795,882 | 8/1905 | Atkin | 292/264 |
| 2,946,213 | 7/1960 | Reiner | 70/93 |
| 3,897,966 | 8/1975 | Draughon, Sr. | 292/264 |
| 4,027,907 | 6/1977 | Crepinsek | 70/93 X |
| 4,174,862 | 11/1979 | Shane | 292/340 X |

*Primary Examiner*—Richard E. Moore

*Attorney, Agent, or Firm*—Robert A. Hirschfeld; James F. Duffy

[57] ABSTRACT

An improved lock strike plate and security chain means are rotatably coupled within a recess within the strike plate means as well as within a recess of the door frame to which the strike plate is mounted. Means are provided within the security chain latching means to inhibit the decoupling of a security chain latched thereto when the door is placed ajar. Further means are provided for exterior key actuation of the chain latch to permit decoupling of the latch from a security chain by a person outside the secured area in an emergency situation. Orthogonal coupling means matingly engaged within the interior of the door frame itself strengthen the strike plate/chain latch assembly, reinforcing the door frame and making that frame a more integral part of the door locking assembly than has been heretofore achieved in the prior art.

21 Claims, 12 Drawing Figures

STRIKE PLATE AND SECURITY CHAIN LATCH

RELATED INVENTIONS

Part of the disclosure herein relative to strike plates with orthogonal coupling means matingly engaged within the interior of a door frame is repeated from the Inventor's Patent Application for REINFORCED ASSEMBLY OF STRIKE PLATE TO DOOR FRAME filed coincident herewith.

BACKGROUND

1. Field of the Invention

The invention relates to the field of security locks for doors.

The invention particularly relates to the field of lock strike plate assemblies of special construction whereby installation of the strike plate to the door frame reinforces the door frame.

The invention specifically relates to the field of reinforced strike plate assemblies to which security chain latch means may be coupled for more secure operation of a security chain used in conjunction with the strike plate assembly.

2. Prior Art

A strike plate, generally manufactured of brass or steel, is mounted to a door frame and is provided with an opening through which the latch or deadbolt of a lock mounted on a door may project and be captively retained therein to secure the door in a locked position. The strike plate is generally maintained in position by two screw fasteners. An impulse of force applied to the door is often sufficient to tear the strike plate from its moorings on the door frame so as to permit the person applying such force free access to the room intended to be secured by the locked door. A maximum security strike, "strike-1." (TM), manufactured by M.A.G. Eng. and Mfg., Inc. is made of high quality 12 gauge steel and is said to add tremendous strength to a doorjamb. It is retained by four two inch and two one inch long hardened screws and is said to be many times stronger than regular strike plates. Nevertheless, the strike plate is mounted only to one side of the door frame, within the doorjamb, and relies on the additional screw fasteners for strength but contributes little to actually reinforcing the door frame itself.

In U.S. Pat. No. 4,027,907 issued to the inventor herein on June 7, 1977, a generally L-shaped strike plate is disclosed in which screw fasteners are employed on the interior surface of the door frame and on the jamb surface of the door frame to retain the L-shaped strike plate in position. The addition of screw fasteners on two orthogonal surfaces of the door frame for mounting the generally L-shaped strike assembly significantly improves the strength of the device when it is positioned on a door and used in cooperation with a door locking device.

The same patent further discloses a security chain latch housing which is pivotally coupled to the exterior surface of the generally L-shaped strike assembly. Because of the orthogonal arrangement of the screw fasteners in mounting the striker to the door frame, the associated chain latch assembly is also strengthened when compared with conventional means for affixing a chain latch to a door frame. The usual manner in which such chain latch assemblies are coupled to the door frame is by means of two threaded screw fasteners. A door ajar and security depending upon the strength of the security chain assembly, prior art devices are prone to fail since an impact readily removes the two screw fasteners holding the prior art chain latch assembly to the door frame.

It is an objective of the present invention to overcome the disadvantages of the prior art with respect to the strength of strike plate assemblies and the mounting of security chain latch means.

It is a particular objective of the invention to provide a strike plate assembly which mounts to a door frame in such a manner as to actually reinforce the door frame and make the frame a more integral part of the securing of the door than has been hitherto available.

It is another objective of the invention to provide a reinforced strike plate assembly to which security chain latch mcans may be coupled in a manner so as to take advantage of the reinforced means whereby the strike plate assembly is mounted to the door frame.

It is a further objective of the invention to provide such a reinforced strike plate assembly having means for recessing a security chain latch means coupled thereto within both said strike plate assembly and said door frame as well.

SUMMARY OF THE INVENTION

The invention disclosed is a reinforced assembly of a lock strike plate in combination with a door frame having at least two orthogonal surfaces. The invention comprises strike plate means having at least two orthogonal faces for mating with two complementary orthogonal surfaces of the door frame, and further comprises orthogonal coupling means matingly coupled within the door frame for coupling the two orthogonal faces of the strike plate means to two complementary orthogonal surfaces of the door frame.

The orthogonal coupling means comprise first reinforcing means coupled to the interior of the door frame through one of the two orthogonal surfaces of the door frame, and second reinforcing means coupled to the interior of the door frame through a second one of the orthogonal surfaces of the door frame.

The first reinforcing means further comprises means for matingly coupling with the second reinforcing means within the interior of the door frame.

The first and second reinforcing means further comprise means for coupling to first and second orthogonal faces of the strike plate means so as to couple these to first and second orthogonal surfaces of the door frame respectively.

To permit the first and second reinforcing means to matingly couple within the interior of the door frame, the first reinforcing means is provided with a through hole into which the second reinforcing means is matingly introduced.

In an alternate embodiment of the invention disclosed herein, the door frame comprises a third surface which is orthogonal to the jamb surface of the door frame. The strike plate means further comprises a third face also orthogonal to the jamb surface of the door frame, and the first reinforcing means further comprises means for coupling this third face of the strike plate to the third surface of the door frame.

In either embodiment disclosed, a security chain latch means may be coupled to the first reinforcing means of the orthogonal coupling means so as to take advantage of the fact. that the orthogonal coupling means are matingly coupled within the door frame and thereby strengthen the door frame itself and thus result in a greatly reinforced attachment of the security chain latch means to the door frame.

In a presently preferred embodiment of the invention, one of the two orthogonal faces of the strike plate is provided with a recess. Within this recess a security chain latch is coupled so as to be housed both within the recess of the strike plate as well as within one of the orthogonal surfaces of the door frame when the strike plate is mated with the door frame. Rotary coupling means for rotatingly coupling the security chain latch means within the recess are also provided.

In a first embodiment of this combination strike plate with recessed chain latch means coupled thereto, the orthogonal coupling means set forth hereinbefore are employed to provide an overall reinforced assembly with the door frame. A second alternative to this embodiment, not presently preferred, discloses only the combination of the L-shaped strike plate with the chain latch housing rotatably recessed within the strike plate and the door frame.

In either of these two latter embodiments, means are provided for rotatingly coupling the security chain latch means within the recess provided in the strike plate and the door frame. The chain latch means comprises a chain latch housing rotatably coupled to an axial pin. A security chain latch is slidingly and rotatably coupled within the security chain latch housing. Means are provided for inhibiting the movement of the security chain latch when the security chain latch housing is rotated out of said recess about the axial pin means.

In a further preferred embodiment of the invention, key lock cylinder means are provided which are key coupled to the chain latch within the latch housing for actuating the chain latch so as to release a security chain attached thereto.

DETAILED DESCRIPTION OF THE INVENTION

Figure 1:
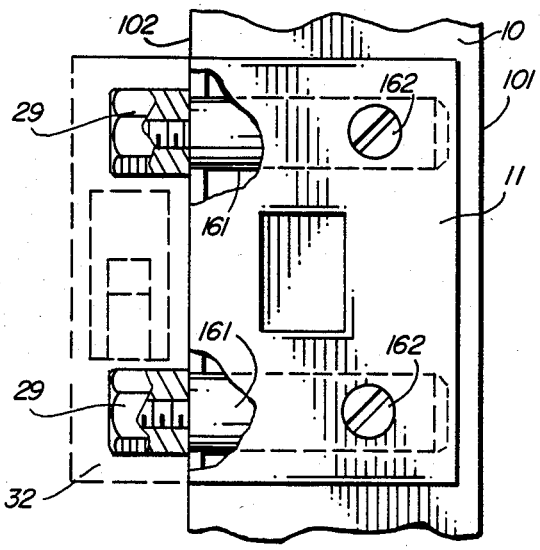
FIG. 1 is an elevation view of a strike plate assembly fastened to a door frame and illustrating in phantom outline a security chain latch means attached thereto.

For the purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

Figure 2:
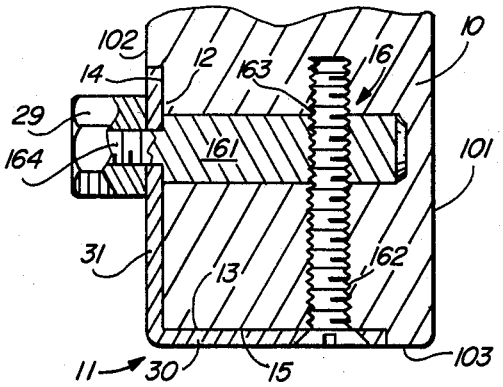
FIG. 2 is a cross-sectional plan view of the assembly of FIG. 1 showing the generally L-shaped strike plate coupled to the door frame by orthogonal coupling means which mate within the interior of the door frame itself.

In FIGS. 1 and 2 are illustrated a portion of a door frame 10 to which is affixed a generally L-shaped strike plate 11. Faces 12 and 13 of strike plate 11 mate with surfaces 14 and 15 of door frame 10.

Orthogonal coupling means 16 are employed to assemble strike plate 11 to door frame 10. Orthogonal coupling means 16 comprise a first reinforcing means 161 having a through hole 163 through which a second reinforcing means 162 is introduced.

First reinforcing means 161 is introduced into door frame 10 from the interior side 102 thereof. Reinforcing means 161 may comprise a bar or cylinder stock having a through hole 163 through which reinforcing means 162 is introduced so that the two reinforcing means 161 and 162 couple matingly within door frame 10. A threaded extension 164 of reinforcing means 161 passes through wall 31 of strike plate 11 and, in combination with cap nut 29, is employed to couple wall 31 to the interior side 102 of door frame 10 bringing the face 12 of strike plate 11 into intimate contact with door frame surface 14.

Second coupling means 162 passes through wall 30 of strike plate 11 and is matingly engaged with through hole 163 of reinforcing means 161. Reinforcing means 162 is a screw threaded fastener which threadedly engages with through hole 163. In the alternative, reinforcing means 162 may be a screw threaded fastener which threadedly engages with door frame 10 passing in close coupling proximity to the walls of through hole 163 of reinforcing means 161.

Because of the manner in which coupling means 16 mates within the interior of door frame 10, door frame 10 is reinforced and becomes a more integral part of the assembly whereby strike plate 11 is affixed to door frame 10. An attempt to force entry through a locked door utilizing strike plate 11 must of necessity result in the removal of a large portion of the door frame 10 itself in order for such forced entry to be successful.

Orthogonal coupling means 16 may be further employed to provide for reinforced mounting of a security chain latch means, illustrated in phantom as reference 32, utilizing threaded ends 164 of reinforcing means 161 and cap nuts 29 as the means for coupling the security latch means 32 to door frame 10. When a door is secured by a security chain attached to chain latch means 32 and the door is placed ajar to permit the occupant of the secured room to ascertain the identity of a person seeking entry, the full reinforced strength provided by orthogonal coupling means 16 is available for securing chain latch means 32 to door frame 10. This arrangement is far superior to the simple two screw threaded fasteners generally employed to hold a security chain latch means to door frame 10.

Figure 3:
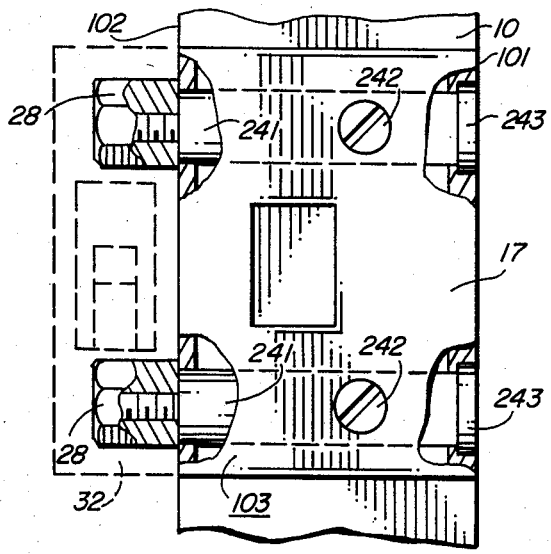
FIG. 3 is an elevation view of an alternate embodiment of the invention of a strike plate coupled to a door frame.
Figure 4:
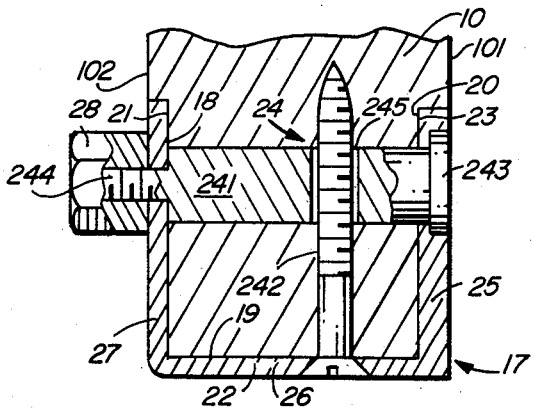
FIG. 4 is a cross-sectional plan view of the assembly of FIG. 3 illustrating the generally U-shaped strike plate assembly coupled to the door frame by orthogonal coupling means which mate within the interior of the door frame itself.

While not presently preferred, an alternate embodiment of a reinforced strike plate 17 is illustrated in FIGS. 3 and 4. Strike plate 17 is generally U-shaped in cross-section. The interfaces 18, 19 and 20 of strike plate 17 mate with surfaces 21, 22 and 23, respectively, of door frame 10. Thus, strike plate 17 encompasses portions of the exterior side 101 of door frame 10 as well as the jamb side 103 and a portion of the interior side 102.

Similar to the orthogonal coupling means 16 already described, orthogonal coupling means 24, which mate within the interior of door frame 10, are employed in affixing strike plate 17 to door frame 10. First reinforcing means 241 passes through wall 25 of strike plate 17 into door frame 10. An enlarged head 243 of reinforcing means 241 is countersunk within wall 25 of strike plate 17. A through hole 245 is provided within reinforcing means 241 to matingly engage with second reinforcing means 242. As before, reinforcing means 242 may be a screw threaded fastener which engages threadedly with either reinforcing means 241 as it passes through through hole 245 or with door frame 10 itself.

Reinforcing means 241 is provided with a screw threaded end 244 which passes through wall 27 of strike plate 17 and, in combination with cap nut 28, fixedly couples strike plate 17 to door frame 10. Second reinforcing means 242, passing through wall 26 of strike plate 17, fixedly couples face 19 of strike plate 17 to surface 22 of door frame 10. This mounting arrangement assures fixed intimate contact of the faces 18, 19 and 20 of strike plate 17 with surfaces 21, 22 and 23, respectively, of door frame 10.

In the manner earlier disclosed, the mating of orthogonal coupling means 24 within the interior of door frame 10 reinforces door frame 10 and makes it a more integral part of the overall assembly such that the removal of a significant portion of the door frame itself is necessitated in attempting a forced entry through a door locked and utilizing strike plate 17.

As mentioned with respect to the generally L-shaped strike plate 11, a security chain latch means 32, shown in phantom outline in FIG. 3, may be coupled to door frame 10 utilizing threaded end portion 244 of reinforcing means 241 and cap nuts 28. Once again, the inherent improved reinforcement provided by orthogonal coupling means 24 greatly reinforces and strengthens the coupling of security chain latch means 32 to door frame 10.

While the embodiments of the invention just disclosed provide for an extremely strong, reinforced assembly of a strike plate to a door frame, the fact that hardware such as cap nuts 28 are exposed at the interior side 102 of door frame 10 may prove distractive to some persons. Although the appearance may be modified by coupling a security chain latch means 32 to the interior face of the strike plate assembly 11 or 17, the fact that such chain latch means intrudes within the room space may still be displeasing to certain people. Such a surface-mounted chain latch means, as depicted in FIGS. 1 and 3 by phantom view 32, is reminiscent of the chain latch means disclosed in U.S. Pat. No. 4,027,907 noted earlier in the background discussion. To provide a less obtrusive assembly, an alternative embodiment of the invention providing a recess within the door frame and strike plate in which security chain latch means may be housed will now be disclosed.

Figure 5:
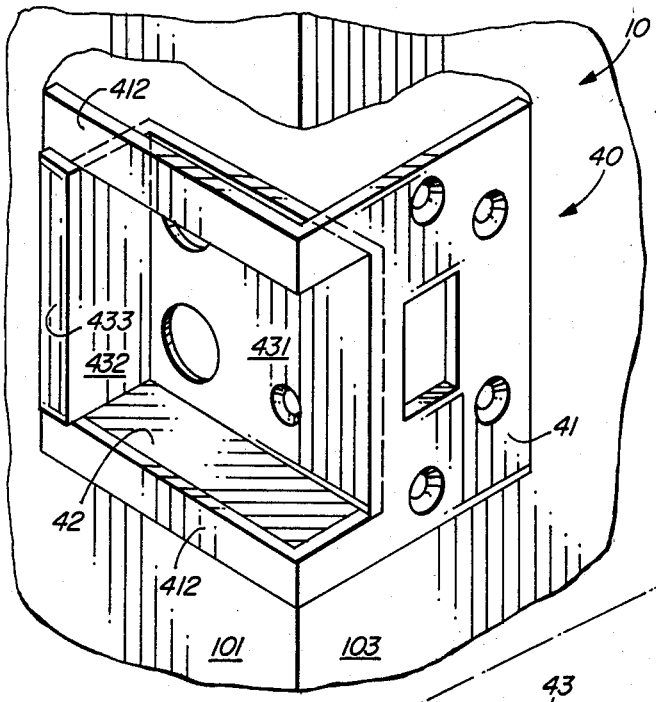
FIG. 5 is a perspective representation of a second alternative embodiment of the invention illustrating a generally L-shaped strike plate provided with a recess which nests within a mating recess of the door frame.
Figure 6:
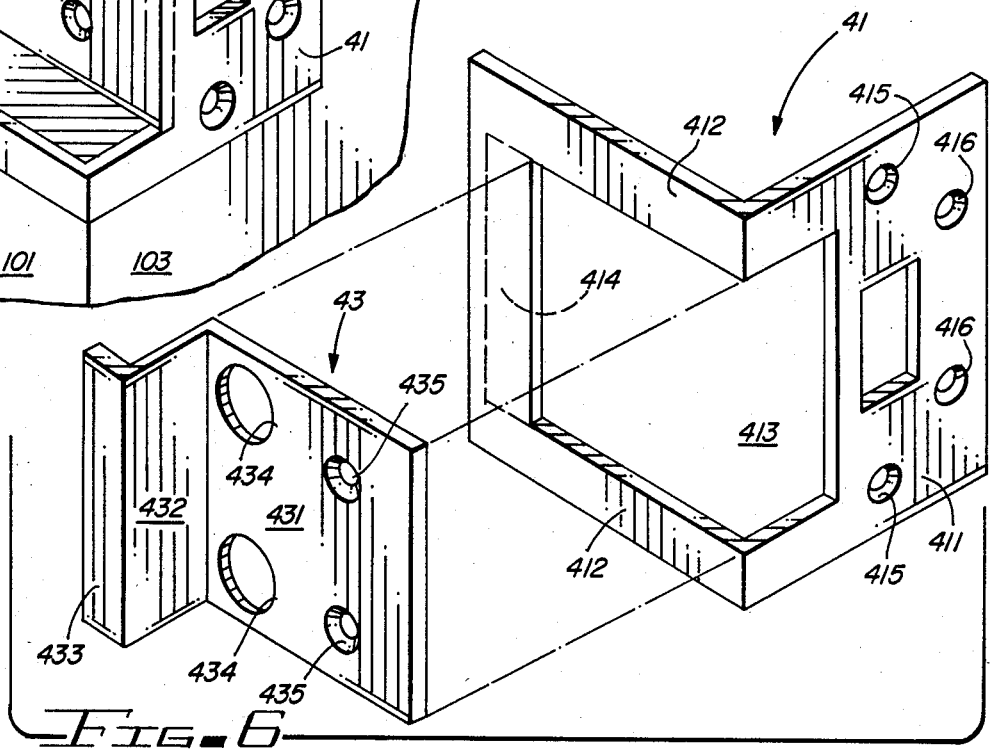
FIG. 6 is an exploded assembly of the generally L-shaped strike plate of FIG. 5 in an embodiment in which the generally L-shaped strike plate with recess therein is assemblied of two mating components.

In FIG. 5 such a modified strike plate assembly 40 is illustrated coupled to a door frame 10. Strike plate 40 comprises a generally L-shaped strike plate 41 having a recess therein nested within a recess of door frame 10. It is anticipated that the generally L-shaped strike plate 41 with recess 42 therein, may be manufactured by stamping strike plate 41 from a single sheet of material. Alternatively, strike plate assembly 40 may be seen to comprise a generally L-shaped strike plate 41 having orthogonal faces 411 and 412 and a cut-out section 413. A second plate 43, being generally Z-shaped in cross-section is inserted within cut-out 413 of strike plate 41 having walls 431 and 432 forming two of the walls of recess 42. Face 433 of Z-shaped plate 43 overlaps shaded area 414 on face 412 of strike plate 41. These elements are illustrated in the exploded perspective view of FIG. 6 and the assembly is as shown in FIG. 5.

Figure 7:
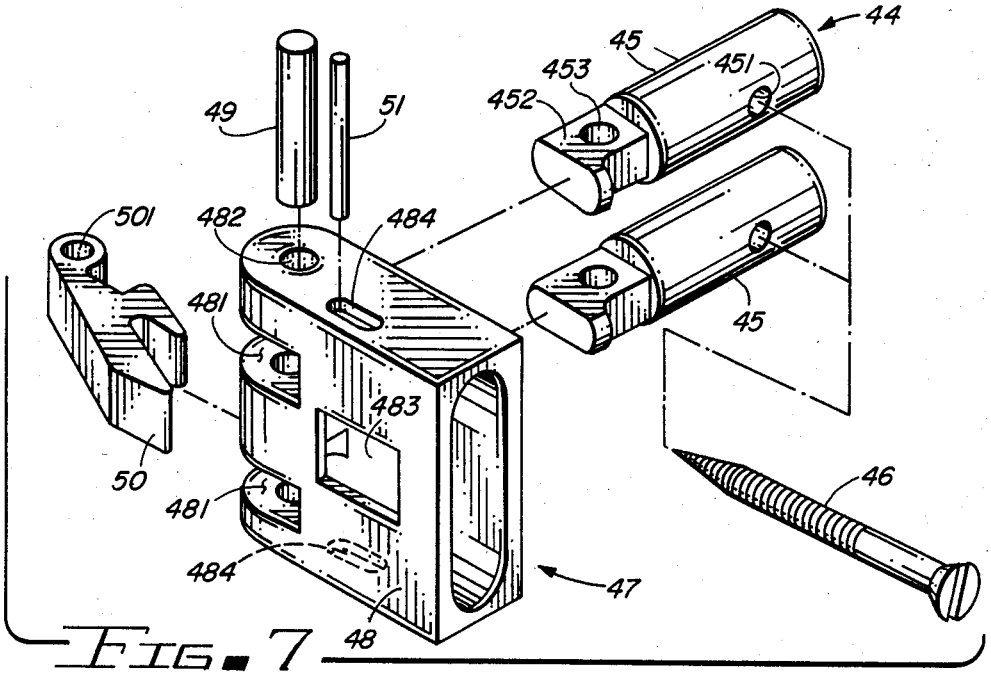
FIG. 7 is an exploded perspective assembly of the orthogonal coupling means for assembling the strike plate of FIG. 5 to the door frame, of a security chain latch housing which is rotatably coupled to said orthogonal coupling means for emplacement within the recess of the generally L-shaped strike plate of FIG. 5; and illustrating the security chain latch which is slidingly and rotatably coupled within the chain latch housing for later coupling with a security chain (not shown).

The means whereby strike plate assembly 40 is assembled to door frame 10 are illustrated in the exploded perspective of FIG. 7. Orthogonal coupling means 44, which matingly engage within the interior of door frame 10 are illustrated here as comprising reinforcing means 45 and 46. As earlier disclosed, reinforcing means 46 engage a through hole 451 in reinforcing means 45. In the assembly to door frame 10, reinforcing means pass through holes 416 in face 411 of strike plate 41.

Reinforcing means are further provided with tab ends 452 each having an axial hole 453 therethrough. Reinforcing means 45 are coupled through holes 434 in the face 431 of plate 43 to thus enter into door frame 10 where they are matingly engaged via through holes 451 with second reinforcing means 46. Tab ends 452 thus project through openings 434 into recess 42. Prior to such installation however, a chain latch housing 48 is coupled to reinforcing means 45.

Chain latch housing 48 is provided with two notches 481 which accommodate tab ends 452 of reinforcing means 45. An axial pin 49 is passed through axial shaftway 482 which aligns with openings 453 in the tab ends 452 of reinforcing means 45. With tab ends 452 engaged within notches 481 and axial pin 49 in place, chain latch housing 48 is free to pivotally rotate about axial pin 49.

A chain latch 50 is introduced into opening 483 in chain latch housing 48 and chain latch shaft 51 is introduced through slots 484 in latch housing 48 so as to pass through an engage shaftway 501 in latch 50. When so assembled, latch 50 is rotatable about shaft 51 which shaft is slidable along the length of slots 484. Thus, latch 50 is rotatably and slidably coupled within latch housing 48. A chain latch means 47 is thereby derived comprising chain latch housing 48, housing shaft 49, latch 50 and latch shaft 51.

Figure 8:
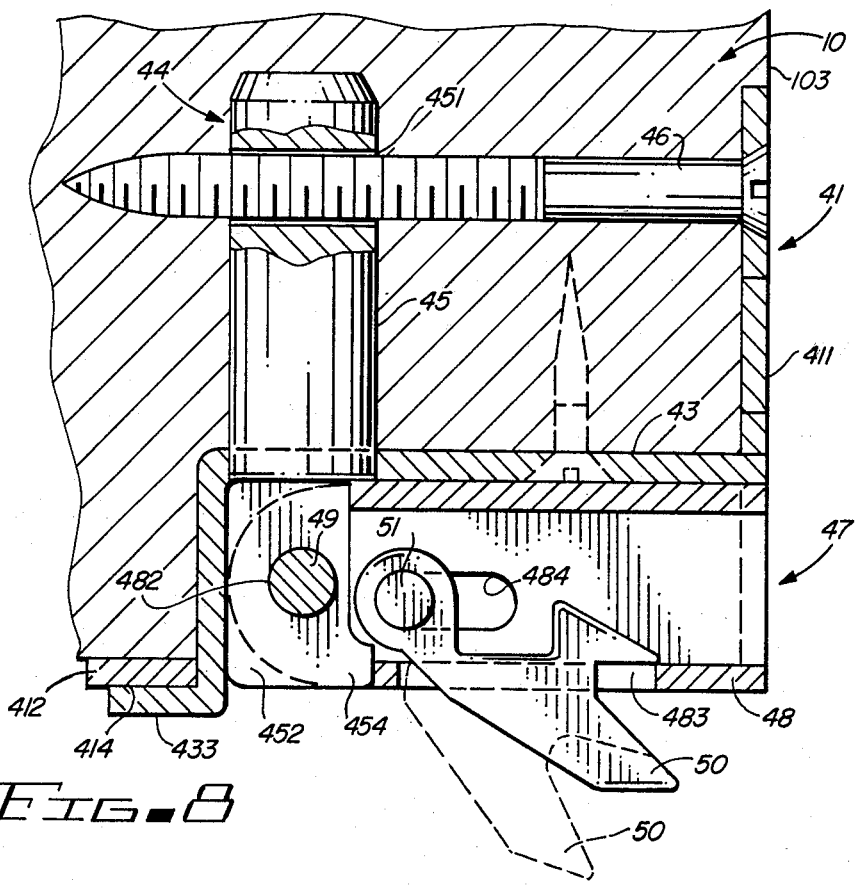
FIG. 8 is a cross-sectional plan view of the assembly of the components illustrated in FIGS. 5 and 7 showing the manner in which the orthogonal coupling means couples the generally L-shaped strike plate to the door frame and the manner in which the security chain latch housing is rotatably coupled within the recess of the strike plate and the chain latch itself is rotatably and slidably coupled within the chain latch housing.
Figure 9:
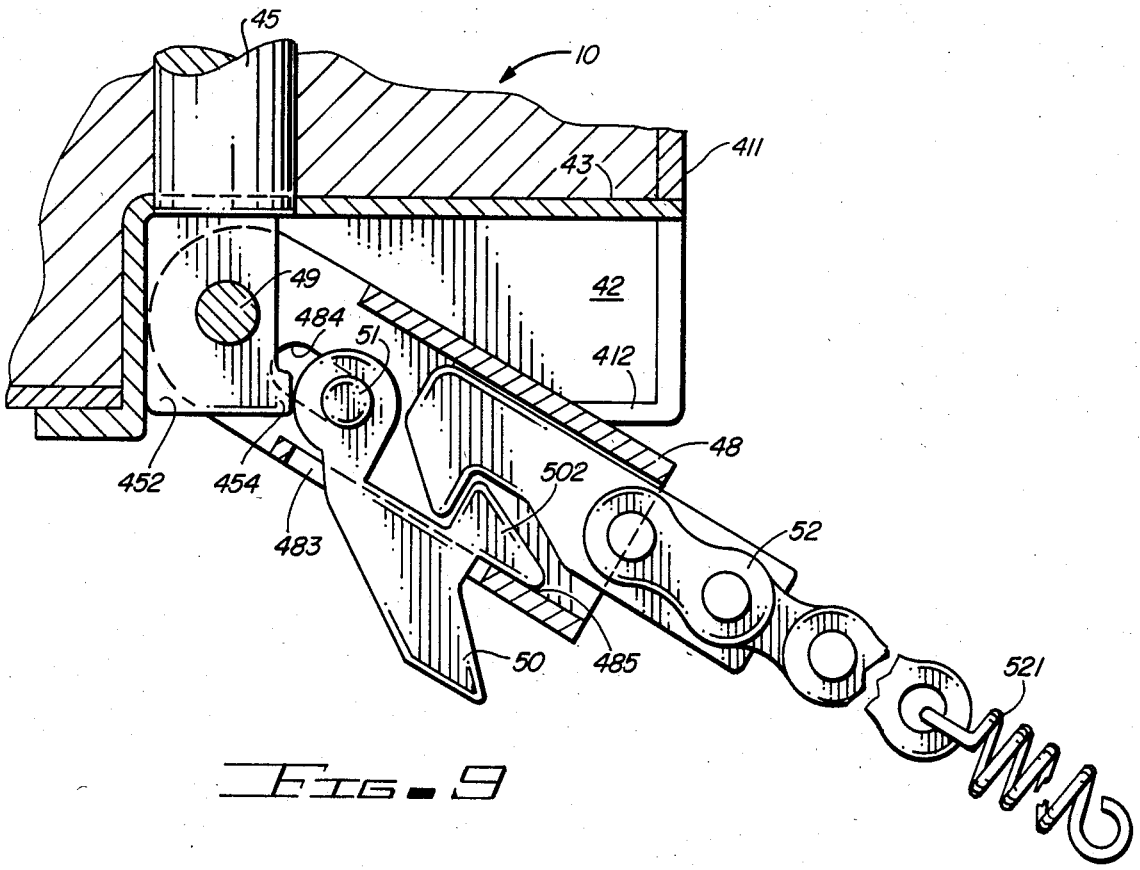
FIG. 9 is a modified cross-sectional view of the assembly of FIG. 8 showing in phantom outline a security chain coupled to the chain latch within the security chain latch housing and the manner in which slide and rotary motion of the chain latch is inhibited when the chain-secured door is placed ajar.

The assembly disclosed immediately above with respect to FIG. 7, may be more readily perceived in the sectional plan views of FIGS. 8 and 9. The orthogonal coupling means 44 is shown as comprising reinforcing bar 45 having a through hole 451 through which second reinforcing means 46 is matingly engaged. In its passage through face 411 of strike plate 41, reinforcing means 46 couples face 411 of strike plate 41 to the jamb surface 103 of door frame 10.

Security chain latch means 47 is emplaced within recess 42 and the passage of axial shaft 49 through tabs 452 of reinforcing means 45 and shaftway 482 of latch housing 48 effectively rotatably couple latch housing 48 to reinforcing means 45 and provide the means whereby plate 43 is maintained in intimate contact with door frame 10. This assembly further maintains face 433 of plate 43 in intimate contact with face 412 of strike plate 41 along surface 414 thereof. Latch means 47 is thus assembled to be recessed both within the confines of latch plate 41 as well as that of door frame 10. With the exception of a small portion of latch 50, little of the assembly obtrudes into the room secured by use of the invention and associated door-mounted locking device.

While not recommended, the strike plate 41, with recessed security latch means 47, could be provided without the orthogonal coupling means 44. In such an event, plate 43 would be provided with tabs similar to end tabs 452 presently shown on reinforcing means 45. The assembly could then be made as previously indicated without the use of reinforcing means 45. Much of the strength of the invention would be obviated, however, if such an assembly were employed.

As shown by the phantom outline of latch 50 in FIG. 8, latch 50 is free to rotate on axial shaft 51 within slots 484. Because of slots 484, latch axial shaft 51 is free to move along the length of slots 484. In FIG. 9, latch shaft 51 is shown displaced to the right of slot 484 which causes latch key 502 of latch 50 to move across surface 485 of latch housing 48 in an interfering relationship to prevent the rotation of latch shaft 51 and thus inhibit the withdraw of latch 50 from opening 483 in latch housing 48. With the motion of latch 50 so inhibited, a security chain 52, shown in phantom outline, coupled to latch 50 will remain so coupled since latch 50 cannot be rotated to disengage itself from chain 52. Latch 50 will be nominally drawn to the position shown in FIG. 9 through the action of spring 521 attached to security chain 52.

To prevent an intruder from attempting to interfere with the latching operation of latch 50 on chain 52, a proturberance 454 on tab 452 of reinforcing means 45 is provided. As chain latch housing 48 is rotated about shaft 49 so as to depart from its nominal closed position within recess 42, as would happen when the door is drawn ajar to permit an occupant of a secured room to view a person on the other side of the secured door, protuberance 454 is brought into contact with latch 50 and causes latch shaft 51 to move along slots 484 (to the right as illustrated in FIG. 9) bringing key 502 of latch 50 into interfering contact with surface 485 of latch housing 48. With the door thus ajar and protuberance 454 maintaining its contact with latch 50, no means may be employed by a potential intruder to displace latch 50 from latch housing 48 so as to decouple latch 50 from chain 52.

The inhibitation of movement of latch 50 when the door is ajar coupled with the strength of the reinforced assembly provided by orthogonal coupling means 44, results in an extremely secure door fastening arrangement.

In transient rooming establishments such as hotels and motels, it is often necessary that the management obtain entry into a room in an emergency situation. For this reason, most such establishments do not provide a security chain closure for the door through which entry to the room is to be had. An embodiment of the invention, now to be disclosed, provides the room occupant with the added security of a chained closure while permitting the management to decouple such chained closure in the event of an emergency.

Figure 10:
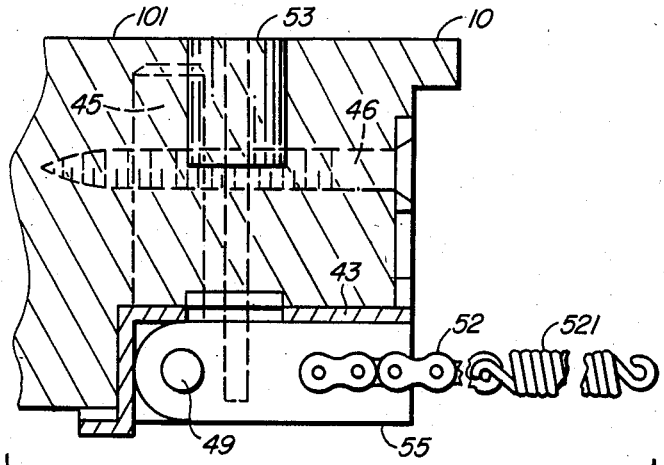
FIG. 10 is a cross-sectional view of another presently preferred embodiment of the invention having provision for exterior key actuation of the chain latch assembly so as to permit emergency decoupling of the security chain from the chain latch.
Figure 11:
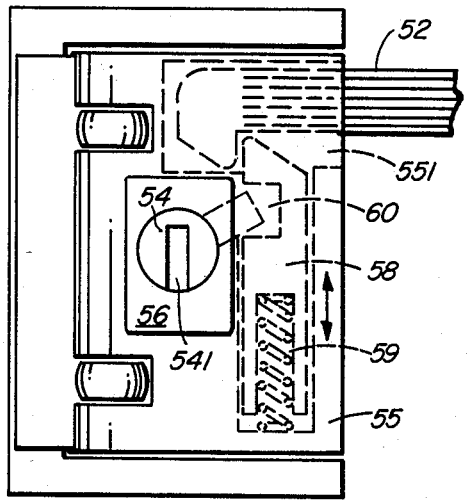
FIG. 11 is an elevation view of the assembly of FIG. 10 showing in greater detail the mechanical workings of the key actuated chain latch.

FIG. 10 depicts a strike plate fastened to doorway 10 by means of orthogonal coupling means 45 and 46 which matingly engage within the interior of door frame 10. Emplaced within the exterior surface 101 of door frame 10 is a key lock cylinder 53. Latch housing 55 is coupled into the recess of the strike plate by means of axial shaft 59. Latch housing 55 differs from latch housing 48 disclosed earlier. Within latch housing 55 is a rotary shaft 54 having a keyway 541 therein. A cam spur 60 is affixed to rotary shaft 54 so as to engage within notch 581 of latch 58. Latch 58 is emplaced within latch housing 55 for sliding motion therein. Spring 59 is provided to urge latch 58 in an upward direction as indicated in FIG. 11. Rotation of shaft 54 causes cam spur 60 to engage latch 58 and drive latch 58 downward against the action of spring 59. When a security chain is inserted into latch housing 55, as indicated in FIG. 11, chain 52 couples with latch 58 and is held within latch housing 59 until shaft 54 is rotated so as to cause cam spur 60 to depress cam 58 thereby decoupling it from chain 52. Spring 521 then urges chain 52 out of its enveloped position within latch housing 55.

Rotation of rotary cylinder 54 is achieved by the insertion of the shaft 571 of key 57 into the keyway 541 of rotary shaft 54. If key 57 complements the cylinder coding of lock cylinder 53, key 57 may be rotated from outside the secured door which will cause chain latch 58 to be depressed which will result in decoupling chain 52 from the latch. Key actuated rotor 54 is carried within rotor housing 56 which is coupled to latch housing 55 in opening 551 thereof. Any available key may be inserted into keyway 541 from the interior of the secured room by the occupant thereof to disengage latch 58 from chain 52.

Figure 12:
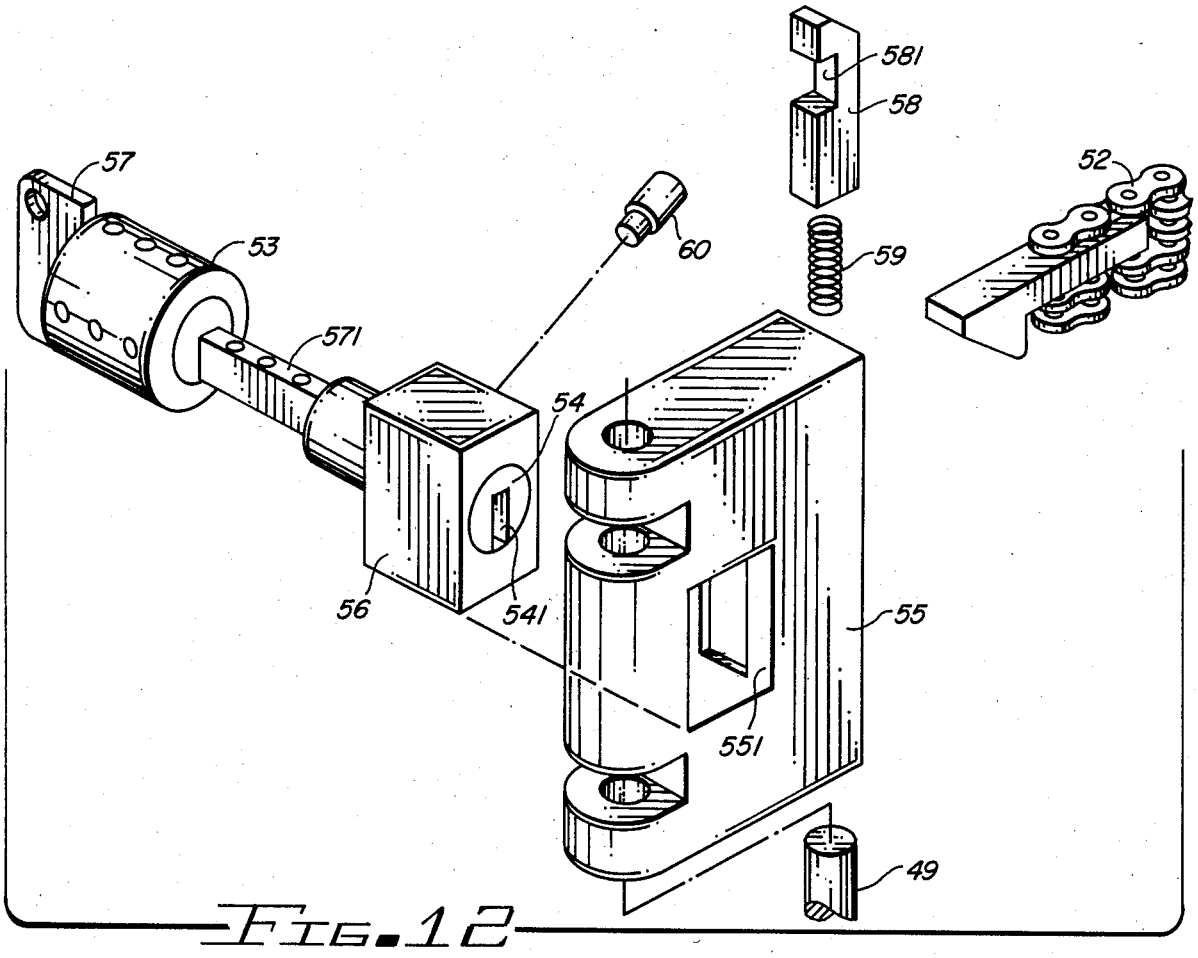
FIG. 12 is an exploded assembly of the key actuated chain latch release mechanism.

Details of the construction of this embodiment of the invention are shown more clearly in the exploded perspective view of the elements depicted in FIG. 12.

When a door utilizing the security chain latch arrangement depicted in FIGS. 10–12 is placed ajar, chain latch housing 55 will rotate away from the strike plate in the manner indicated earlier with respect to chain latch housing 58 as shown in FIG. 9 with respect thereto. Under such circumstances, a key 57 inserted into lock cylinder 53 will not be able to couple with keyway 541 of key actuated rotor 54. Thus, it will be impossible for an intruder having a key accommodated by lock cylinder 53 to disengage security chain 52 from latch 58 while the door is ajar. To successfully enter a room secured by the invention, an intruder must have not only a key which actuates security chain latch 58 but also an additional key which will be accommodated by the conventional door-mounted door lock.

What has been disclosed is an improved lock strike plate and security chain latch means rotatably coupled within a recess within the strike plate means as well as within a recess of the door frame to which the strike plate is mounted. Means are provided within the security chain latching means to inhibit the decoupling of a security chain latched thereto when the door is placed ajar. Further means are provided for exterior key actuation of the chain latch to permit decoupling of the latch from a security chain by a person outside the secured area in an emergency situation. Orthogonal coupling means matingly engaged within the interior of the door frame itself strengthen the strike plate/chain latch assembly, reinforcing the door frame and making that frame a more integral part of the door locking assembly than has been heretofore achieved in the prior art.

Those skilled in the art will conceive of other embodiments of the invention to be drawn from the teachings herein. To the extent that such embodiments are so drawn, it is intended that they shall fall within the ambit of protection of the claims appended hereto.

Having described my invention in the foregoing specification and the accompanying drawings in such significant detail that those skilled in the art may easily understand and readily practice the invention, that which I claim is:

1. In combination with a door frame having at least two orthogonal surfaces an improved lock strike plate and security chain latch comprising:

strike plate means having at least two orthogonal faces mating with two complementary with two complementary orthogonal surfaces of said door frame;

security chain latch means recessed within a first one of said two orthogonal faces of said strike plate means and being further recessed within one of said at least two orthogonal surfaces of said door frame when said strike plate face is so mated with said door frame surface, wherein said first one of said two orthogonal faces of said strike plate means comprises a recess for receiving said security chain latch means;

rotary coupling means for rotatingly coupling said security chain lath means within said recess; and orthogonal coupling means matingly coupled within said door frame for coupling said at least two orthogonal faces of said strike plate means to two complementary orthogonal surfaces of said door frame, wherein said orthogonal coupling means comprises first reinforcing means coupled to the interior of said door frame through a first one of said at least two orthogonal surfaces of said door frame, said orthogonal coupling means further comprises a second reinforcing means coupled to the interior of said door frame through a second one of said at least two orthogonal surfaces of said door frame, first reinforcing means further comprises means for matingly coupling with said second reinforcing means within the interior of said door frame.

2. The strike plate and chain latch of claim 1 wherein said first reinforcing means further comprises means for coupling a first of said at least two orthogonal faces of said strike plate means to said first one of said at least two orthogonal surfaces of said door frame.

3. The strike plate and chain latch of claim 2 wherein said means for coupling a first of said at least two orthogonal faces of said strike plate means to said first one of said at least two orthogonal surface of said door frame further comprises means for coupling security chain latch means thereto.

4. The strike plate and chain latch of claim 3 wherein said second reinforcing means further comprises means for coupling a second of said at least two orthogonal faces of said strike plate means to said second one of said at least two orthogonal surfaces of said door frame.

5. The strike plate and chain latch of claim 4 wherein:

said first reinforcing means comprises reinforcing bar means; and said means for matingly coupling with said second reinforcing means comprises a through hole in said reinforcing bar means into which said second reinforcing means is matingly introduced.

6. The strike plate and chain latch of claim 4 wherein said second reinforcing means comprises a screw threaded fastener threadedly engaged with said door frame and passing through said through hole in said first reinforcing means to matingly engage therewith.

7. The strike plate and chain latch of claim 4 wherein said rotary coupling means for rotatingly coupling said security chain latch means within said recess of said first one of said two orthogonal faces of said strike plate means comprises axial pin means for rotatingly coupling said security chain latch means to said first reinforcing means.

8. The strike plate and chain latch of claim 7 wherein said means for coupling a first of said at least two orthogonal faces of said strike plate means to said first one of said at least two orthogonal surfaces of said door frame comprises said axial pin means and said security chain latch means coupled thereto.

9. The strike plate and chain latch claim 7 wherein said security chain latch means comprises security chain latch housing means rotatingly coupled to said axial pin means.

10. The strike plate and chain latch of claim 9 wherein said security chain latch means further comprises a security chain latch slidingly, rotatingly coupled within said security chain latch housing means.

11. The strike plate and chain latch of claim 10 further comprising means for inhibiting movement of said security chain latch when said security chain latch housing is rotated out of said recess about said axial pin means.

12. The strike plate and chain latch of claim 9 wherein said security chain latch means further comprises a security chain latch slidingly coupled within said security latch housing means.

13. The strike plate and chain latch of claim 12 further comprising rotary means coupled to said security chain latch for slidingly actuating said security chain latch within said security chain latch housing means.

14. The strike plate and chain latch of claim 13 further comprising key lock cylinder means key coupled to said rotary means for key actuating said latch within said latch housing.

15. The strike plate and chain latch of claim 1 wherein said rotary coupling means for rotatingly coupling said security chain latch means within said recess of said first one of said two orthogonal faces of said strike plate means comprises axial pin means.

16. The strike plate and chain latch of claim 15 wherein said security chain latch means comprises security chain latch housing means rotatingly coupled to said axial pin means.

17. The strike plate and chain latch of claim 16 wherein said security chain latch mean further comprises a security chain latch slidingly, rotatingly coupled within said security chain latch housing means.

18. The strike plate and chain latch of claim 17 further comprising means for inhibiting movement of said security chain latch when said security chain latch housing is rotated out of said recess about said axial pin means.

19. The strike plate and chain latch of claim 15 wherein said security chain latch means further comprises a security chain latch slidingly coupled within said security latch housing means.

20. The strike plate and chain latch of claim 19 further comprising rotary means coupled to said security chain latch for slidingly actuating said security chain latch within said security chain latch housing means.

21. The strike plate and chain latch of claim 20 further comprising key lock cylinder means key coupled to said rotary means for key actuating said latch within said latch housing.

* * * * *